US011650616B2

(12) United States Patent
Collins et al.

(10) Patent No.: US 11,650,616 B2
(45) Date of Patent: May 16, 2023

(54) COMBINED FUNCTION JOYSTICK FOR DRILLING MACHINE AND RELATED METHOD

(71) Applicant: J.H. FLETCHER & CO., Huntington, WV (US)

(72) Inventors: Craig Matthew Collins, Huntington, WV (US); Robert Dale Groves, Jr., Huntington, WV (US)

(73) Assignee: J.H. FLETCHER & CO., Huntington, WV (US)

( * ) Notice: Subject to any disclaimer, the term of this patent is extended or adjusted under 35 U.S.C. 154(b) by 96 days.

(21) Appl. No.: 16/489,986

(22) PCT Filed: May 16, 2018

(86) PCT No.: PCT/US2018/032921

§ 371 (c)(1),
(2) Date: Aug. 29, 2019

(87) PCT Pub. No.: WO2018/213416

PCT Pub. Date: Nov. 22, 2018

(65) Prior Publication Data

US 2020/0081478 A1 Mar. 12, 2020

Related U.S. Application Data

(60) Provisional application No. 62/507,490, filed on May 17, 2017.

(51) Int. Cl.
*E21B 7/02* (2006.01)
*G05G 9/047* (2006.01)

(52) U.S. Cl.
CPC ..... *G05G 9/047* (2013.01); *E21B 7/022* (2013.01); *G05G 2009/04774* (2013.01)

(58) Field of Classification Search
CPC .... E21B 7/022; G05G 9/047; G05G 9/04788; G05G 2009/04774
See application file for complete search history.

(56) References Cited

U.S. PATENT DOCUMENTS

| | | | | |
|---|---|---|---|---|
| 5,875,701 | A | 3/1999 | Cobo et al. | |
| 8,136,612 | B2 | 3/2012 | Carlson et al. | |
| 2016/0281430 | A1* | 9/2016 | Davis | E21B 7/025 |
| 2017/0101860 | A1* | 4/2017 | Nieminen | E21B 19/18 |

FOREIGN PATENT DOCUMENTS

| | | | |
|---|---|---|---|
| GB | 1202530 | A | 8/1970 |
| RU | 90489 | U1 | 1/2010 |
| WO | 2007026051 | A1 | 3/2007 |

OTHER PUBLICATIONS

English machine translation of RU90489.

* cited by examiner

*Primary Examiner* — Kristyn A Hall
(74) *Attorney, Agent, or Firm* — Dickinson Wright PLLC; Andrew D. Dorisio

(57) ABSTRACT

An apparatus for drilling with a drilling machine including a boom for supporting a drill and a feed for feeding the drill. A single joystick is adapted for controlling the movement of the boom and the feed independently or together, such as according to different protocols (e.g., for causing movement of the boom and feed in the same direction, or in different directions). Related methods are also disclosed.

21 Claims, 6 Drawing Sheets

COMBINED FUNCTION JOYSTICK FOR DRILLING MACHINE AND RELATED METHOD

This application claims the benefit of U.S. Provisional Patent Application Ser. No. 62/507,490, the disclosure of which is incorporated herein by reference.

TECHNICAL FIELD

This disclosure relates to the drilling arts and, more particularly, to a combined function joystick for a drilling machine and related method.

BACKGROUND

Drilling machines such as "jumbo" drills often include a boom for raising and lowering the drill and a separate feed for feeding the drill to and fro. In the typical arrangement where there is joystick control, the operator must use the joystick to control the boom, and then switch the control so that the joystick controls the feed. In many cases, however, the same movement of the joystick could be used to move both the boom and feed together at the same time, such as when both are to be raised in the same direction for drilling a new borehole in a mine face or the like, or perhaps when it is necessary to move the feed and boom in different directions, such as to achieve a particular orientation.

Accordingly, a need is identified for a joystick that addresses the foregoing limitations, and perhaps others that have yet to be discovered. The joystick would allow for the selective combining of the boom and feed movements, thereby making the drilling operation far more efficient than in past arrangements where separate control was required. The enhanced operation may lead to significant savings in the cost of a drilling operation, especially in relation to use in recovering valuable deposits from the Earth, such as in the course of mining coal or the like.

SUMMARY

According to a first aspect of the disclosure, an apparatus comprises a drilling machine including a boom for supporting a feed for feeding a drill and a single joystick adapted for controlling movement of the boom and the feed independently or together. In one embodiment, the single joystick includes an input for causing a combined control of the boom and feed movement. The input may comprise a button or a trigger.

In one embodiment, the single joystick includes a first input for combining the boom and feed movement according to a first protocol and a second input combining the boom and feed movement according to a second protocol. The single joystick may further include a third input that, when combined with the first input or the second input, is for combining the boom and feed movement according to a third protocol. One input may be for causing the boom and feed to each independently move in the same direction at the same time. One input may be for causing the boom and the feed to each independently move in different directions at the same time. The single joystick may include an input for controlling the movement of the feed independent of the boom, and the boom independent of the feed, depending on a state of the input. A controller may also be provided for receiving output signals from the single joystick and controlling a boom actuator and a feed actuator.

A further aspect of the disclosure pertains to an apparatus for controlling a machine, such as a jumbo drill for drilling one or more boreholes in a face of a mine passage. The apparatus may include a controller and a joystick. The machine may include, such as for example on the joystick, a first input for signaling the controller to control the movement of first and second components of the machine according to a first protocol and a second input signaling the controller to control the movement of first and second components of the machine according to a second protocol.

In one embodiment, the first component comprises a boom and the second component comprises a feed for feeding a drill, and wherein: (1) the first protocol causes the boom and feed to move in a corresponding direction; and (2) the second protocol causes the boom and feed to move in an opposite direction. The first input may comprise a first button on the joystick and the second input comprises a second button on the joystick, the first button for generating a first output signal to the controller for activating the first protocol and the second button for generating a second output signal to the controller for activating the second protocol. One of the first or second inputs (or a third input for working in concert with the first or second inputs to create a third movement protocol for the boom and feed) may comprise a trigger.

Still a further aspect of the disclosure comprises an apparatus in the form of a drilling machine with a boom for supporting a feed for feeding a drill. The machine includes a joystick for controlling the boom and the feed to move in a corresponding direction or an opposite direction based on a user input. The joystick may comprise a first button for providing the user input for controlling the boom and food to move in the corresponding direction. The joystick may comprise a second button for providing the user input for controlling the boom and food to move in the opposite direction. The joystick may comprise a trigger.

In any embodiment, a display may be provided for graphically displaying a condition of the joystick. The display may form part of the drilling machine, such as by being positioned adjacent to the joystick(s) in an operator's cab. The drilling machine may further comprise a vehicle, such as for example a wheeled vehicle.

Yet a further aspect of the disclosure relates to a method of controlling a drilling machine. The method comprises simultaneously controlling movement of a boom associated with the drilling machine and a feed associated with the boom and independently movable relative to the boom using a single input device. In one example, the single input device comprises a joystick including an input for selectively combining the movement of the feed and the boom, and the method includes activating the input to combine the movement of the feed and the boom. In another example, the single input device comprises a joystick including a first input for selectively combining the movement of the feed and the boom according to a first protocol, and a second input for selectively combining the movement of the feed and boom according to a second protocol, and the method includes activating the first or second inputs to combine the movement of the feed and the boom according to the first or second protocols.

In any case, the first protocol may comprise moving the feed and the boom in the same direction, and the second protocol may comprise moving the feed and the boom in different directions. The joystick may include a third input, and the method includes activating the third input with either the first input or the second input to cause movement of the boom and feed according to a third protocol.

Still further, the disclosure relates to a method of controlling a drilling machine. The method comprises providing a single joystick for simultaneously controlling movement of a boom associated with the drilling machine and a feed associated with the boom according to a first protocol or a second protocol. The providing step may comprise pressing a first button on the single joystick for implementing the first protocol or a second button on the joystick for implementing the second protocol. The method may further include the step of pressing a third button on the single joystick in combination with either the first button or the second button to implement a third protocol.

Another aspect of the disclosure pertains to a method of controlling a drilling machine. The method comprises simultaneously controlling movement of a boom associated with the drilling machine and a feed associated with the boom according to a first protocol or a second protocol using a single joystick. The method may further include pressing a first button on the single joystick for implementing the first protocol or a second button on the joystick for implementing the second protocol. The method may further include pressing a third button on the single joystick in combination with either the first button or the second button to implement a third protocol.

In the following description, several embodiments of the combined function joystick for a drilling machine and related method are shown and described. As it should be realized, the arrangement is capable of other, different embodiments and its several details are capable of modification in various, obvious aspects all without departing from the invention as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the combined function joystick for drilling machine and related method and, together with the description, serve to explain certain principles thereof. In the drawing figures.

Figure 4:
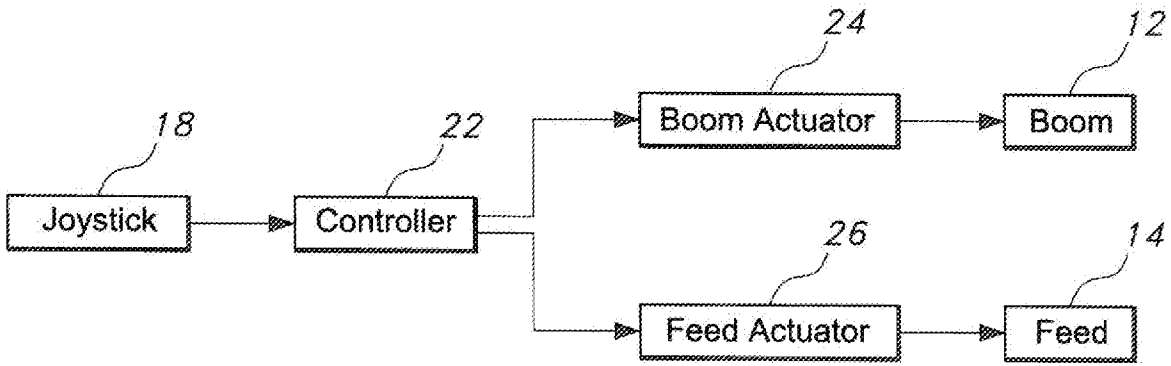

FIG. 4 schematically illustrates the interaction between the joystick and an associated control system for controlling the boom and feed movement; and FIGS. 5, 6, 7, and 8 illustrate various sequences of control that may be created according to various control protocols using the joystick of the present disclosure.

Reference will now be made in detail to the present preferred embodiments of the combined function joystick for drilling machine and related method, examples of which are illustrated in the accompanying drawing figures.

DETAILED DESCRIPTION

Figure 1:
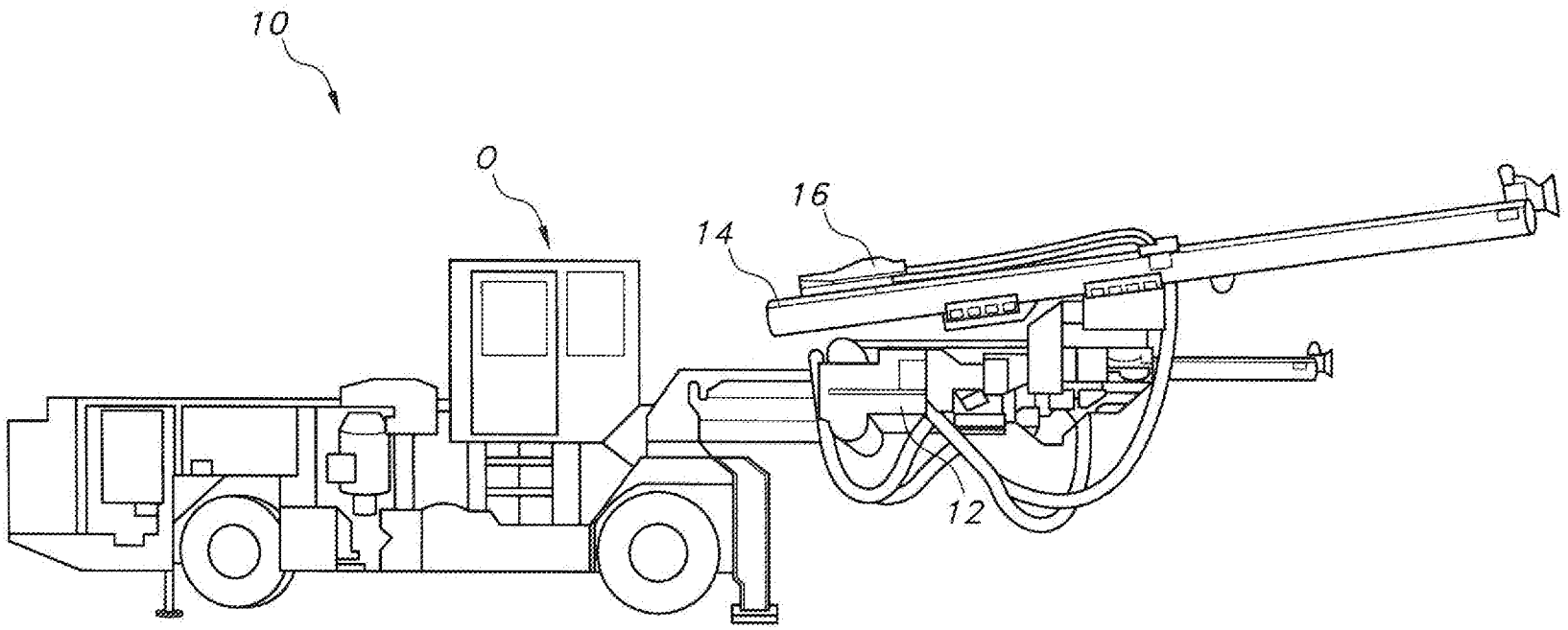
FIG. 1 is a side view of a drilling machine.

In one aspect, this disclosure relates to a drilling machine 10, such as a "jumbo" drill, an example of which is shown in FIG. 1. The machine 10 may include one or more booms 12 (two in the illustrated example, but fewer or more may be present), each of which may support a feed 14 (sometimes called a feed "beam") for feeding (e.g., advancing and retracting) a movable drill head 16 for forming a borehole. The machine 10 is typically a vehicle capable of being driven about to place the boreholes at desired locations, which may then be loaded with charges, anchors, or the like. The particular use of the boreholes is not considered important to the disclosed invention.

Figure 2B:
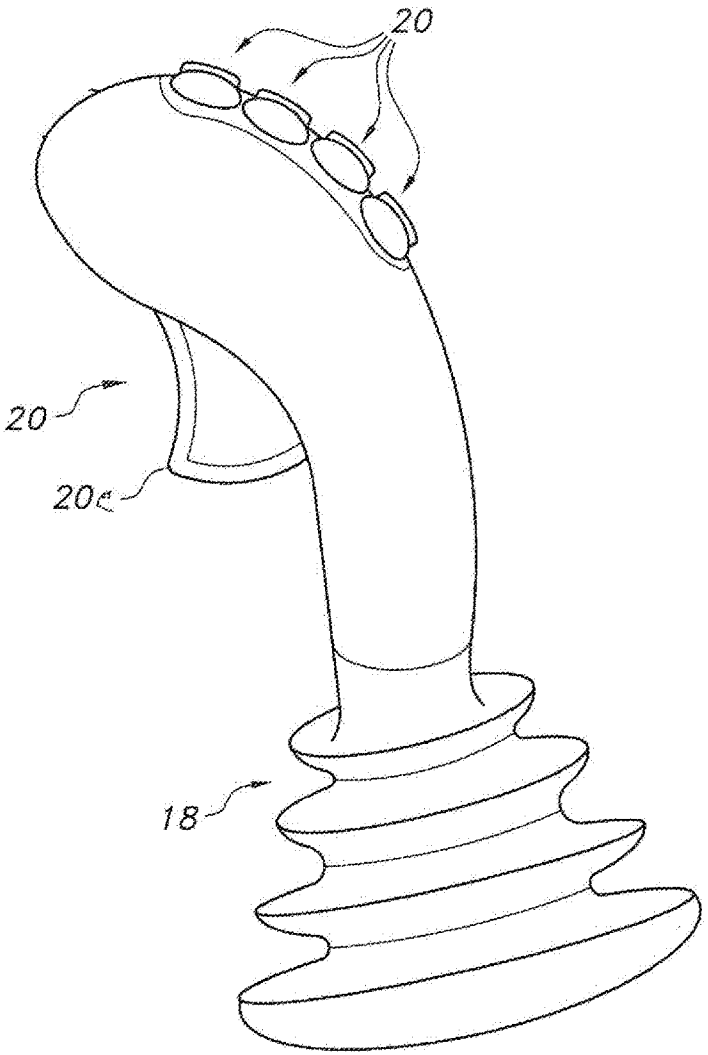
FIG. 2B is a side view of the joystick of FIG. 2A.
Figure 2A:
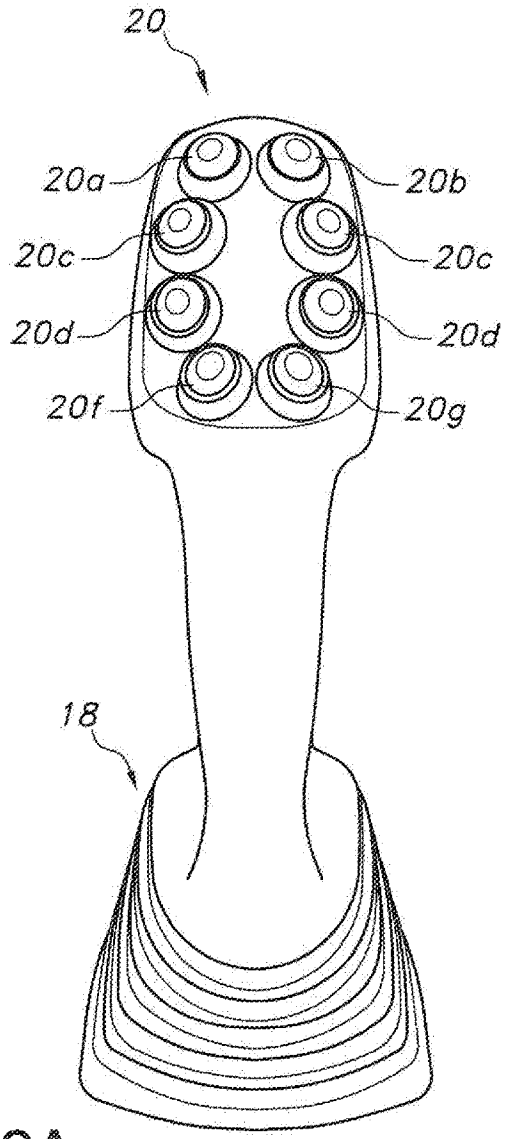
FIG. 2A is a front view of a joystick.
Figure 3:
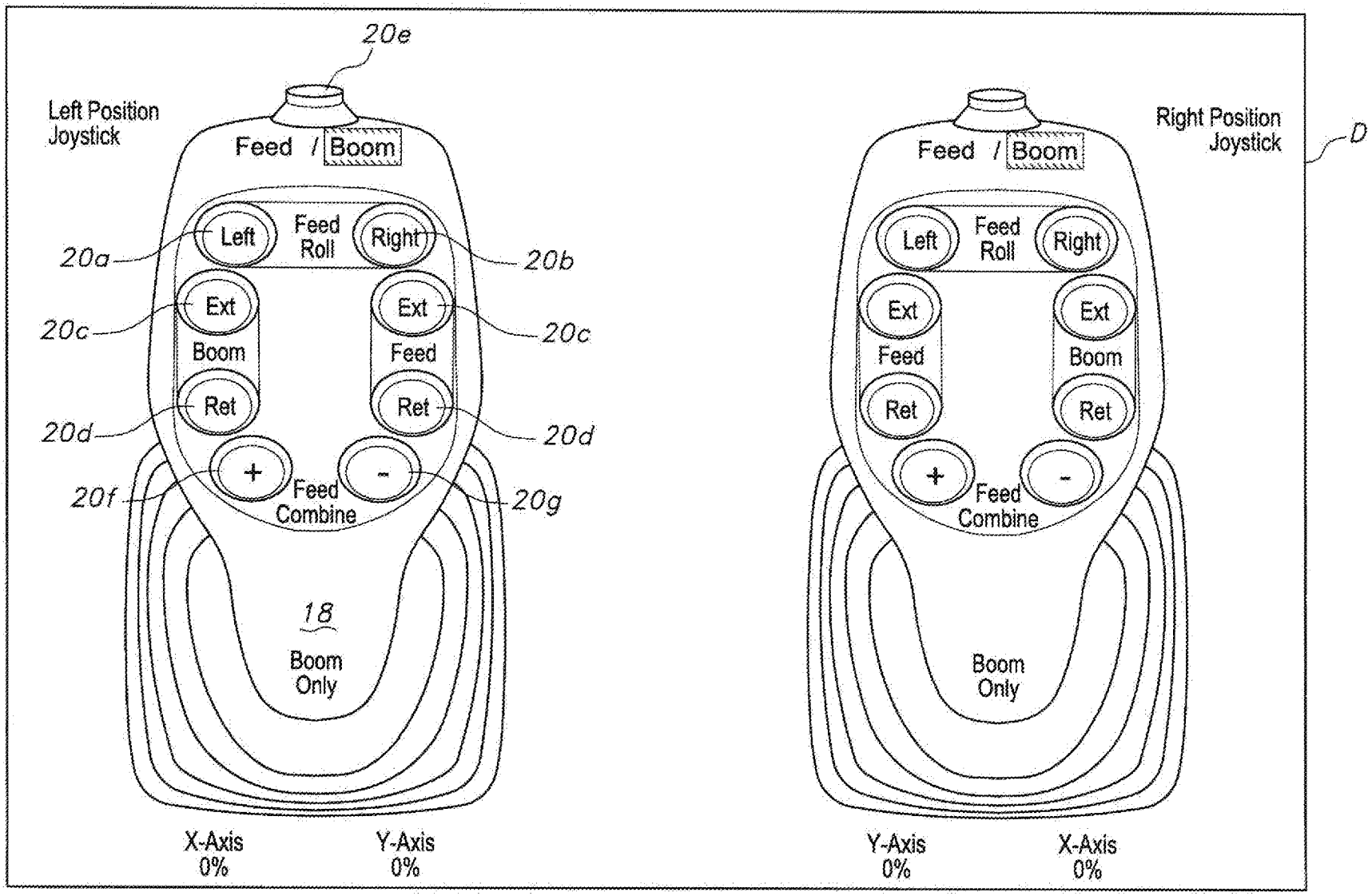
FIG. 3 illustrates a display for displaying the operating condition of a plurality of joysticks used in connection with the drilling machine.

Referring now to FIGS. 2A, 2B, and 3, the drilling machine 10 may include a single input device, such as a multi-axis joystick 18 for commonly controlling the movement and position of the boom 12 and the feed 14. The joystick 18 may include one or more individual inputs 20 for selecting which function is controlled, which may be provided on a head portion 18*a* of the joystick or elsewhere.

In the illustrated example, the inputs 20 of the joystick 18 may be for controlling various functions of the drilling machine 10 and, in particular, the movement of the boom 12 and feed 14. For example, the inputs 20 may include buttons 20*a*, 20*b* for feed roll, buttons 20*c*, 20*d* for boom or feed extension or retraction, and a button 20*e* for selecting whether the joystick independently controls the boom 12 or the feed 14. In addition, one or more buttons 20*f*, 20*g* (indicated as "+" and "−") may be provided for allowing the operator to selectively combine the control of the boom and feed such that the two operate simultaneously based on the movement of the joystick 18, as outlined in more detail in the following description. One or more of the inputs 20 may also comprise a trigger 20*e* associated with the joystick 18.

The joystick 18 may be physically located in the operator's cab O of the drilling machine 10. As shown in FIG. 4, a graphical display D may be provided on the machine 10, such as in the operator's cab O, to allow the operator to visualize in real time the input provided via joystick 18 and the associated inputs 20, textually, graphically, or both. Two joysticks are shown on the display D for controlling left and right booms 12 and corresponding feeds 14, and would correspond to two joysticks, which may be identical to joystick 18. However, in the event a single boom/feed is provided, a single joystick may be used, as can more than two joysticks for more than two booms/feeds or for controlling additional components (e.g., tramming of the drilling machine 10), depending on the particular application.

FIG. 4 schematically illustrates the manner in which a single joystick 18 may control the movement of the boom 12 and/or feed 14. Output signals from the joystick 18 may be provided to a controller 22, which in turn independently controls the boom actuator 24 (which may include separate lift or extend functions) and the feed actuator 26 (which may include lift, extend, and roll functions). The particular actuators 24, 26 used may comprise, for example, a plurality of independently operable hydraulic cylinders for causing movement in the desired manner (e.g., side-to-side, lift, extend, retract, and/or roll) corresponding to the operator input received via joystick 18, which actuation arrangement is considered to be conventional.

Figure 5:
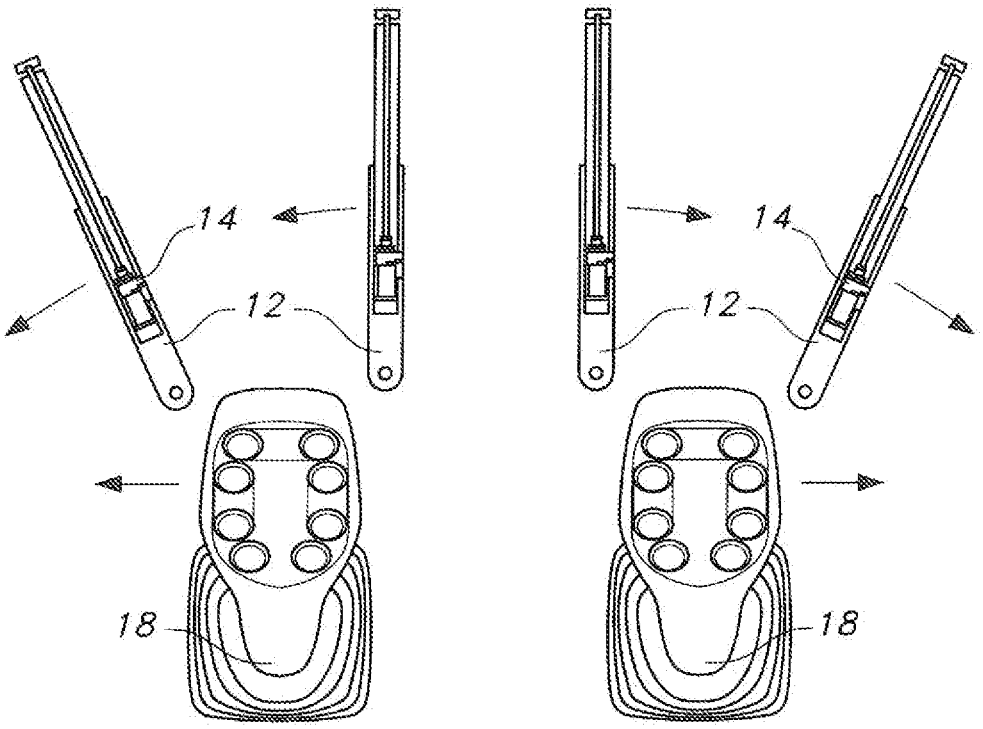
Figure 6:
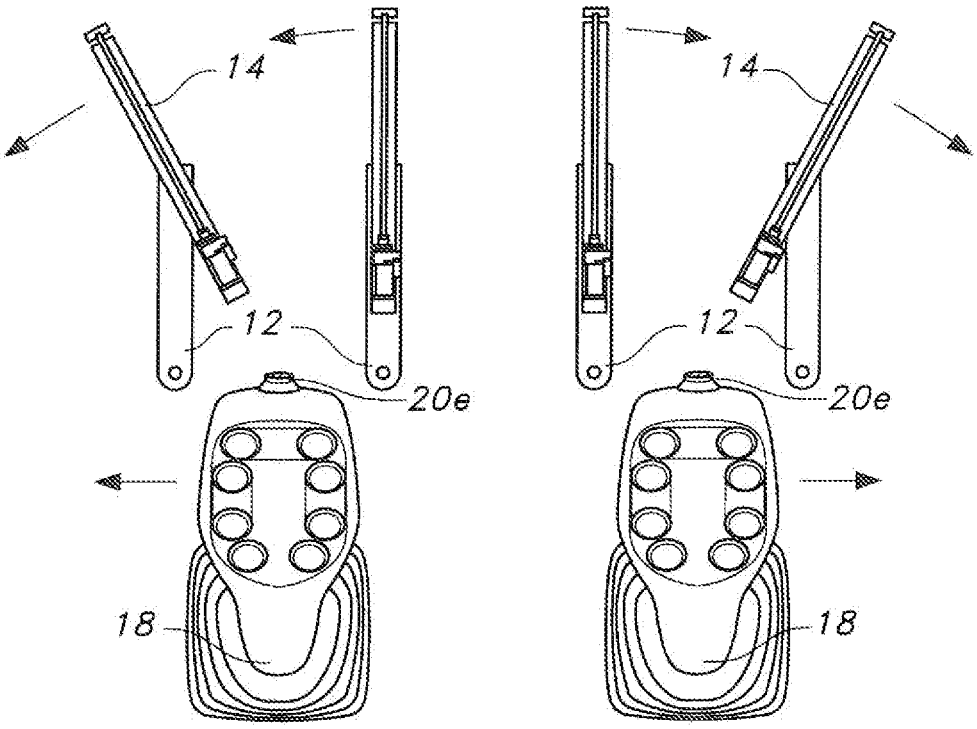

With reference now to FIGS. 5, 6, 7, and 8, use of the joystick 18 according to one aspect of the disclosure is illustrated. FIG. 5 illustrates that the joystick 18 may be used to control the movement of the boom 12, such as by moving the joystick left or right and a corresponding movement is created in the boom (and the feed 14 carried by the boom 12 of course tracks or follows this movement, but remains fixed in position relative to the boom). Likewise, when control of the feed 14 is desired, a corresponding input may be provided, such as via button or trigger 20*e*, to allow for the feed 14 to be controlled independent of the boom 12, as indicated in FIG. 6 (note relative movement of feed 14 compared to the stationary boom 12).

Figure 7:
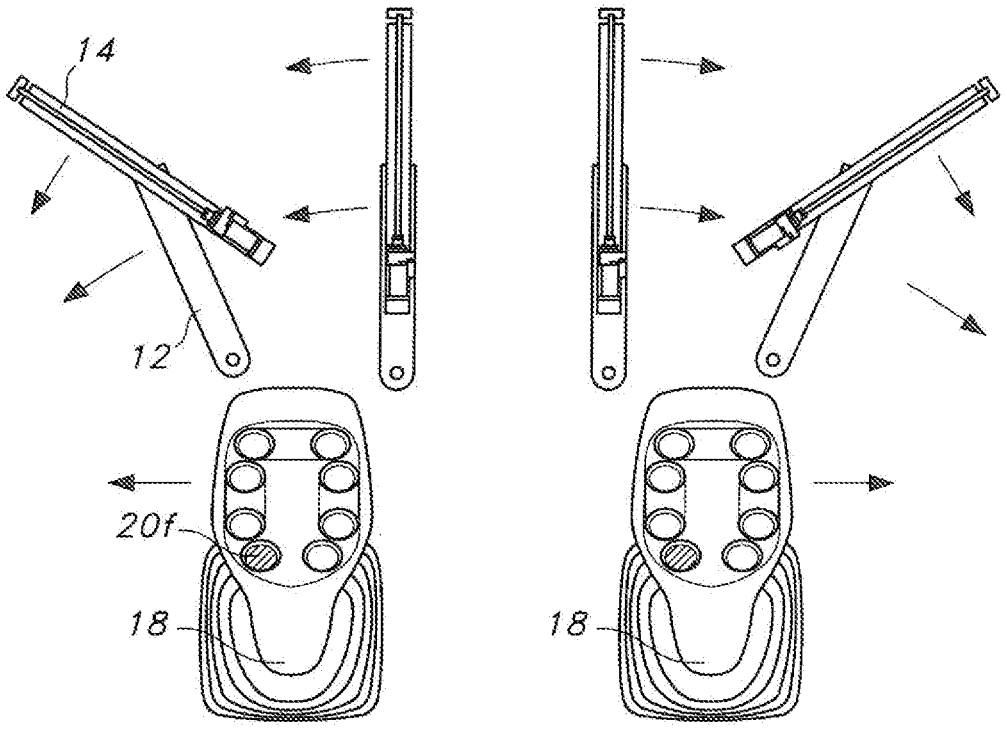
Figure 8:
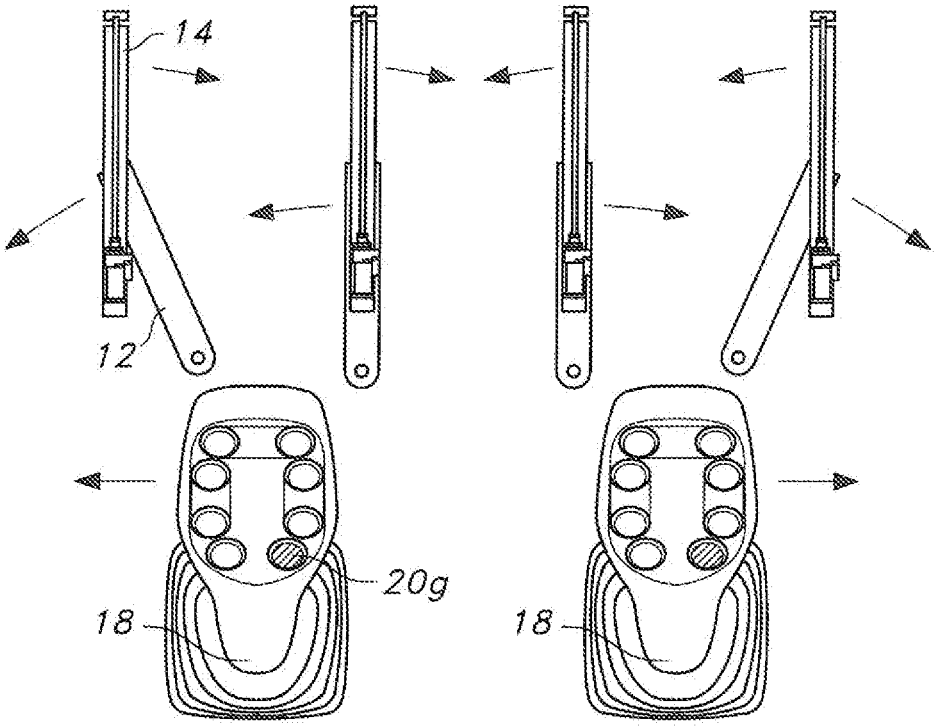

When the "combine" feature is enabled, such as by creating an input to the controller 22 by pressing button 20*f* ("+"), the joystick 18 simultaneously controls both the boom 12 and the feed 14. In one example, the control may be achieved according to different protocols, depending on the input provided (as may be assessed by controller 22). In one example, the first protocol is to move the boom 12 and feed 14 in concert in the selected (same) direction (swing, or both lift and swing), as indicated in FIG. 7. When another input is provided, such as when button 20*g* ("−") is pressed in concert with the movement of the joystick 18, the boom 12 and feed 14 react or move according to a second protocol. This second protocol may involve moving the boom 12 and feed 14 (swing, or both lift and swing) in different (e.g., opposite) directions, as shown. Activation in this manner may also be combined with a feature to cause the feed 14 to tilt in the same direction as the boom 12 is being raised, which is considered optional.

Operation may also be arranged to proceed according to a third protocol different from the first and second protocols when a third input is provided. For example, if the trigger 20*e* is depressed while the feed combine "+" button 20*f*, the joystick 18 may operate to cause the boom 12 to swing, as well as the boom to lift and the feed 14 to swing in the same direction as the boom swing and feed tilt in the same direction as boom lift. This reflects a third protocol, which it can be appreciated may be achieved by combining two inputs (but could also be assigned to a single input, if desired).

Example

An example of one possible use of the combined joystick is as follows:

- Without button or trigger 20*e*, joystick 18 operates boom swing (left and right joystick movement) and boom lift (forward and rear).
- With button or trigger 20*e*, joystick 18 operates feed swing (left and right) and feed tilt (forward and rear).
- Without button or trigger 20*e*, joystick buttons 20*a*, 20*b* operate feed roll.
- With button or trigger 20*e*, joystick buttons 20*a*, 20*b* operate tilt.
- With feed combine "+" button 20*f*, joystick 18 operates boom swing and boom lift and feed swing in the same direction as the boom swing.
- Feed combine "−" button 20*g*, joystick 18 operates boom swing and boom lift and feed swing in the opposite direction as the boom swing
- Button/trigger 20*e* and feed combine "+" button 20*f*, joystick 18 operates boom swing and boom lift and feed swing in the same direction as the boom swing and feed tilt in the same direction as boom lift.
- Button/trigger 20*e* and feed combine "−" button 20*g*, joystick 18 operates boom swing and boom lift and feed swing in the opposite direction as the boom swing and feed tilt in the same direction as boom lift.

Of course, various other combinations can be made depending on the particular desire of an end user or application.

In summary, the ability to cause simultaneous movement of a boom 12 and feed 14 of a drilling machine 10 is advantageously provided. The control is further enhanced by allowing the operator to combine the movement according to first and second protocols, such as coordinating the movement in the same or different directions. In this manner, operation of the drilling machine 10 may be made more efficient, and the associated costs of the operation reduced.

This disclosure may be considered to relate to the following items:

1. An apparatus, comprising:
   a drilling machine including a boom for supporting a feed for feeding a drill;
   and a single joystick adapted for controlling movement of the boom and the feed independently or together.
2. The apparatus of item 1, wherein the single joystick includes an input for causing a combined control of the boom and feed movement.
3. The apparatus of any of the foregoing items, wherein the input comprises a button.
4. The apparatus of any of the foregoing items, wherein the input comprises a trigger.
5. The apparatus of any of the foregoing items, wherein the single joystick includes a first input for combining the boom and feed movement according to a first protocol and a second input combining the boom and feed movement according to a second protocol.
6. The apparatus of any of the foregoing items, further including a third input that, when combined with the first input or the second input, is for combining the boom and feed movement according to a third protocol.
7. The apparatus of any of the foregoing items, wherein the single joystick includes an input for causing the boom and feed to each independently move in the same direction at the same time.
8. The apparatus of any of the foregoing items, wherein the single joystick includes an input for causing the boom and the feed to each independently move in different directions at the same time.
9. The apparatus of any of the foregoing items, wherein the single joystick includes an input for controlling the movement of the feed independent of the boom, and the boom independent of the feed, depending on a state of the input.
10. The apparatus of any of the foregoing items, further including a controller for receiving output signals from the single joystick and controlling a boom actuator and a feed actuator.
11. An apparatus for controlling a machine, comprising:
    a controller; and
    a joystick having a first input for signaling the controller to control the movement of first and second components of the machine according to a first protocol and a second input signaling the controller to control the movement of first and second components of the machine according to a second protocol.
12. The apparatus of item 11, wherein the first component comprises a boom and the second component comprises a feed for feeding a drill, and wherein: (1) the first protocol causes the boom and feed to move in a corresponding direction; and (2) the second protocol causes the boom and feed to move in an opposite direction.
13. The apparatus of item 11 or item 12, wherein the first input comprises a first button on the joystick and the second input comprises a second button on the joystick, the first button for generating a first output signal to the controller for activating the first protocol and the second button for generating a second output signal to the controller for activating the second protocol.
14. The apparatus of item 11, item 12, or item 13, wherein one of the first or second inputs comprises a trigger.
15. An apparatus, comprising:
    a drilling machine including a boom for supporting a feed for feeding a drill; and a joystick for controlling the boom and the feed to move in a corresponding direction or an opposite direction based on a user input.

16. The apparatus of item 15, wherein the joystick comprises a first button for providing the user input for controlling the boom and food to move in the corresponding direction.
17. The apparatus of item 15 or item 16, wherein the joystick comprises a second button for providing the user input for controlling the boom and food to move in the opposite direction.
18. The apparatus of item 15, item 16, or item 17, wherein the joystick comprises a trigger.
19. A display for graphically displaying a condition of the joystick of any of items 1-18.
20. A drilling machine including the apparatus of any of items 1-19.
21. A vehicle including the apparatus of any of items 1-20.
22. A method of controlling a drilling machine, comprising:

simultaneously controlling movement of a boom associated with the drilling machine and a feed associated with the boom and independently movable relative to the boom using a single input device.

23. The method of item 22, wherein the single input device comprises a joystick including an input for selectively combining the movement of the feed and the boom, and the method includes activating the input to combine the movement of the feed and the boom.
24. The method of item 22 or item 23, wherein the single input device comprises a joystick including a first input for selectively combining the movement of the feed and the boom according to a first protocol, and a second input for selectively combining the movement of the feed and boom according to a second protocol, and the method includes activating the first or second inputs to combine the movement of the feed and the boom according to the first or second protocols.
25. The method of item 24, wherein the first protocol comprises moving the feed and the boom in the same direction, and the second protocol comprises moving the feed and the boom in different directions.
26. The method of item 24, wherein the joystick includes a third input, and the method includes activating the third input with either the first input or the second input to cause movement of the boom and feed according to a third protocol.
27. A method of controlling a drilling machine, comprising:

providing a single joystick for simultaneously controlling movement of a boom associated with the drilling machine and a feed associated with the boom according to a first protocol or a second protocol.

28. The method of item 27, wherein the providing step comprises pressing a first button on the single joystick for implementing the first protocol or a second button on the joystick for implementing the second protocol.
29. The method of item 27 or item 28, further including the step of pressing a third button on the single joystick in combination with either the first button or the second button to implement a third protocol.
30. A method of controlling a drilling machine, comprising:

simultaneously controlling movement of a boom associated with the drilling machine and a feed associated with the boom according to a first protocol or a second protocol using a single joystick.

31. The method of item 30, wherein the controlling step comprises pressing a first button on the single joystick for implementing the first protocol or a second button on the joystick for implementing the second protocol.
32. The method of item 30 or item 31, further including the step of pressing a third button on the single joystick in combination with either the first button or the second button to implement a third protocol.

Although this disclosure provides illustrative descriptions and presentations of concepts by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component", "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated component(s), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. The phrases "consisting of" or "consists of," as used herein, means "including and limited to."

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. "Generally polygonal" means that the shape has flat surfaces, as with a polygon, but may have rounded corners connecting these surfaces.

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. An apparatus, comprising:

a drilling machine including a boom for supporting a feed for feeding a drill; and a single joystick adapted for controlling movement of the boom and the feed independently or together;

wherein the single joystick includes an input for causing a combined control of the boom and feed movement.

2. The apparatus of claim 1, wherein the input comprises a button.

3. The apparatus of claim 1, wherein the input comprises a trigger.

4. The apparatus of claim 1, wherein the input comprises a first input for combining the boom and feed movement according to a first protocol and wherein the single joystick includes a second input combining the boom and feed movement according to a second protocol.

5. The apparatus of claim 4, further including a third input that, when combined with the first input or the second input, is for combining the boom and feed movement according to a third protocol.

6. The apparatus of claim 1, wherein the input causes the boom and feed to each independently move in the same direction at the same time.

7. The apparatus of claim 1, wherein the input causes the boom and the feed to each independently move in different directions at the same time.

8. The apparatus of claim 1, wherein the input is further adapted for controlling the movement of the feed independent of the boom, and the boom independent of the feed, depending on a state of the input.

9. The apparatus of claim 1, further including a controller for receiving output signals from the single joystick and controlling a boom actuator and a feed actuator.

10. The apparatus of claim 1, wherein the input comprises a button or trigger.

11. A display for graphically displaying a condition of the joystick of claim 1.

12. A drilling machine including the apparatus of claim 1.

13. An apparatus for controlling a machine, comprising:

a controller; and a joystick having a first input for signaling the controller to control the movement of first and second components of the machine according to a first protocol and a second input signaling the controller to control the movement of first and second components of the machine according to a second protocol.

14. The apparatus of claim 13, wherein the first component comprises a boom and the second component comprises a feed for feeding a drill, and wherein: (1) the first protocol causes the boom and feed to move in a corresponding direction; and (2) the second protocol causes the boom and feed to move in an opposite direction.

15. The apparatus of claim 14, wherein the first input comprises a first button on the joystick and the second input comprises a second button on the joystick, the first button for generating a first output signal to the controller for activating the first protocol and the second button for generating a second output signal to the controller for activating the second protocol.

16. The apparatus of claim 13, wherein one of the first or second inputs comprises a trigger.

17. The apparatus of claim 13, wherein first input comprises a first button or a first trigger and the second input comprises a second button or a second trigger.

18. An apparatus, comprising:

a drilling machine including a boom for supporting a feed for feeding a drill; and a joystick adapted for controlling the boom and the feed to move in a corresponding direction or an opposite direction based on an actuation of a user input associated with the joystick, wherein said user input comprises a button or trigger.

19. The apparatus of claim 18, wherein the user input comprises a first button for controlling the boom and feed to move in the corresponding direction.

20. The apparatus of claim 18, wherein user input comprises a second button for controlling the boom and feed to move in the opposite direction.

21. The apparatus of claim 18, wherein the user input comprises a trigger.

* * * * *